US005644945A

United States Patent [19]

Baldwin et al.

[11] Patent Number: 5,644,945

[45] Date of Patent: Jul. 8, 1997

[54] CRIMPING DIE FOR USE IN A CRIMPING MACHINE

[75] Inventors: Arden E. Baldwin, Peoria; Peter Kalman, Pekin, both of Ill.

[73] Assignee: Caterpillar Inc., Peoria, Ill.

[21] Appl. No.: 625,617

[22] Filed: Mar. 29, 1996

[51] Int. Cl.[6] ..... B21D 39/04; B21D 41/04

[52] U.S. Cl. ..... 72/402; 29/237

[58] Field of Search ..... 72/402; 29/237; 279/46.7, 43.7

[56] References Cited

U.S. PATENT DOCUMENTS

| | | | |
|---|---|---|---|
| 2,374,245 | 4/1945 | Stoner | 279/46 |
| 2,829,899 | 4/1958 | Drew | 279/46.7 |
| 2,880,007 | 3/1959 | Stoner | 279/46.7 |
| 2,985,454 | 5/1961 | Stoner | 279/46.7 |
| 2,985,456 | 5/1961 | Stoner | 279/46.7 |
| 3,022,082 | 2/1962 | Haviland | 279/46.7 |
| 3,093,182 | 6/1963 | Vanderhoof | 153/1 |
| 3,742,754 | 7/1973 | Jeromson | 72/402 |
| 3,750,452 | 8/1973 | Frank | 72/402 |
| 4,309,892 | 1/1982 | Currie | 72/402 |
| 4,357,822 | 11/1982 | Patel | 72/402 |
| 4,400,967 | 8/1983 | Owens | 72/402 |
| 4,527,414 | 7/1985 | Jurkovic et al. | 72/402 |
| 4,577,485 | 3/1986 | Moreiras | 72/402 |
| 4,836,091 | 6/1989 | Taylor | 279/46.7 |
| 4,858,938 | 8/1989 | Terwilliger | 279/46.7 |
| 4,887,451 | 12/1989 | Hoff | 72/402 |
| 5,029,881 | 7/1991 | Godfrey | 279/46.7 |

FOREIGN PATENT DOCUMENTS

| | | | |
|---|---|---|---|
| 2214339 | 1/1976 | Germany | 27/10 |
| 0084713 | 3/1982 | United Kingdom | 27/10 |
| 0147971 | 11/1984 | United Kingdom | 39/4 |

*Primary Examiner*—Daniel C. Crane
*Attorney, Agent, or Firm*—O. Gordon Pence

[57] ABSTRACT

A crimping die is provided for use in a crimping machine for radially crimping the collar of a hose coupling onto the end of a hose. The crimping die includes a die assembly having a plurality of die segments and at least one unitary retention and separator band. The die segments are adapted for arrangement into a circular array about a central axis, with each of the die segments having a radially inner surface forming a section of a common collar bore about the central axis for receipt of the collar of the hose coupling. Each die segment includes a top surface having an arcuate groove formed therein. The groove has a predetermined cross-sectional configuration with an open upper end that is provided with a lesser width than the width of at least a portion of the groove below the upper end. The unitary retention and separator band is constructed of an elastomeric material and has a like plurality of die segment retaining portions and a plurality of spacer portions. Each retaining portion has a cross-sectional configuration that mates with and is adapted for receipt into the groove of a respective one of the segments for retaining the segments together. The spacer portions are spaced along the band for disposition between adjacent ones of the die segments and have a length to space the segments a predetermined distance apart when the die assembly is in a free state.

12 Claims, 4 Drawing Sheets

CRIMPING DIE FOR USE IN A CRIMPING MACHINE

TECHNICAL FIELD

This invention relates to crimping machines for radially crimping or contracting the collar of a hose coupling onto the end of a hose and more particularly to a crimping die for use in such crimping machine.

BACKGROUND ART

It is common practice in producing hose assemblies to permanently secure a metal hose coupling onto the end of a hose by plastically deforming or crimping an outer sleeve of the fitting around the hose end to cause the hose to be tightly held between an outer collar or sleeve of the coupling and a fitting nipple positioned inside the hose. In the crimping process, the entire collar of the coupling is engaged by the crimping die of the crimping machine. The crimping die reduces the collar in diameter to secure the coupling to the hose end.

Conventional crimping machines typically have a die plate with a frusto-conical through bore adapted to receive a crimping die with a mating radially outer conical surface. The crimping die is typically constructed from a plurality of pie-shaped segments arranged around a central axial bore. The segments are spaced apart from each other in an expanded mode so as to permit the hose coupling which is to be crimped to be placed in the central bore. The segments are then driven, typically by a hydraulic jack of the crimping machine, into the conical bore of the die plate, which converts the axial movement of the die segments into a radial contraction by the camming action of the conical bore of the die plate. Thus, the die segments are compressed radially so as to make the central bore smaller and causing the radially inner surfaces of the die segments forming the bore to work the metal of the hose coupling and to radially reduce its size.

As the die assembly is typically constructed from a plurality of die segments, usually 4 to 10 in number, it has been found to be useful to provide suitable means for holding a number of such die segments together in either circular or semi-circular arrays to facilitate their handling and use. It has also been found to be useful to provide suitable means for maintaining the segments in a spaced apart relationship prior to the crimping operation and to return the segments to such spaced apart relationship after the crimping operation so as to allow the insertion and removal of the hose coupling from the die assembly. Many prior art die assemblies have attempted to accomplish these functions. For instance in U.S. Pat. No. 4,309,892 issued Jan. 12, 1982 to William E. Currie for a Crimping Machine, each die segment is connected to an adjacent die segment by means of an intermediate rigid link secured by a pair of link pins. In U.S. Pat. No. 3,750,452 issued Aug. 7, 1973 to Irving Frank for a Collet Crimper, the use of individual resilient or rubber spacer members is disclosed. Such spacers are secured to both adjacent die segments by bonding to the adjoining radial surfaces of the segments, thereby both spacing the segments apart and holding the segments together. In U.S. Pat. No. 4,400,967 issued Aug. 30, 1983 to Carl H. Owens for a Crimping Collet, the use of a pair of resilient pads is disclosed for spacing the die segments apart. However in this patent, the pair of pads are only bonded to one of the adjacent segments and thus are used only for spacing purposes. In order to hold the segments of the entire die assembly together, a pair of elastomeric rings are used, which encircle all of the die segments. Such elastic rings are situated in grooves formed in the radially outer surfaces of the die segments.

The various prior attempts at spacing the die segments of a crimping die and in holding the die segments together each have short comings and other problems that limit their usefulness. For instance, some methods make it difficult to remove individual dies segments from the crimping die so that such die segments can be easily replaced when they become worn or damaged. Others methods are subject to bond failure, resulting in the loss of the separating or retention functions altogether and causing damage to the die assembly and/or to the hose coupling. Still others provided exposed grooves or other discontinuities along the radially outer conical surfaces of the die segments, which can produce instability and less mating surface contact between the die segment and the die plate allowing galling or other surface damage to occur. The present invention is directed to overcoming the preceding shortcomings of such prior devices.

Disclosure of the Invention

In one aspect of the present invention, a crimping die is provided for use in a crimping machine for radially crimping the collar of a hose coupling onto the end of a hose. The crimping die includes a die assembly having a plurality of die segments and at least one unitary retention and separator band. The die segments are adapted for arrangement into a circular array about a central axis, with each of the die segments having a radially inner surface forming a section of a common collar bore about the central axis for receipt of the collar of the hose coupling. Each die segment includes a top surface having an arcuate groove formed therein. The groove has a predetermined cross-sectional configuration with an open upper end that is provided with a lesser width than the width of at least a portion of the groove below the upper end. The unitary retention and separator band is constructed of an elastomeric material and has a like plurality of die segment retaining portions and a plurality of spacer portions. Each retaining portion has a cross-sectional configuration that mates with and is adapted for receipt into the groove of a respective one of the segments for retaining the segments together. The spacer portions are spaced along the band for disposition between adjacent ones of the die segments and have a length to space the segments a predetermined distance apart when the die assembly is in a free state.

BEST MODE FOR CARRYING OUT THE INVENTION

Figure 1:
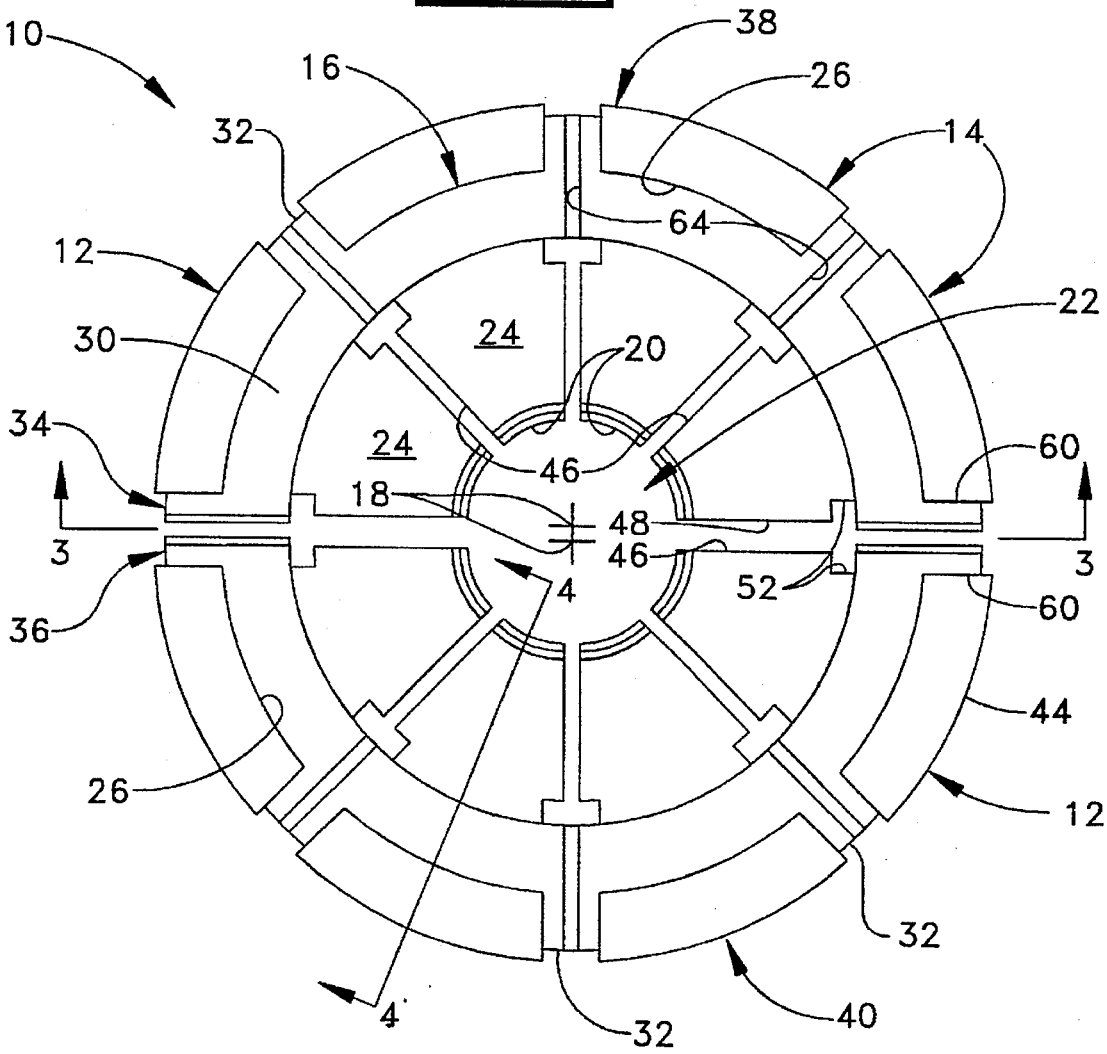
FIG. 1 is a top elevational view of a crimping die embodying the principles of the present invention for use in a crimping machine.
Figure 2:
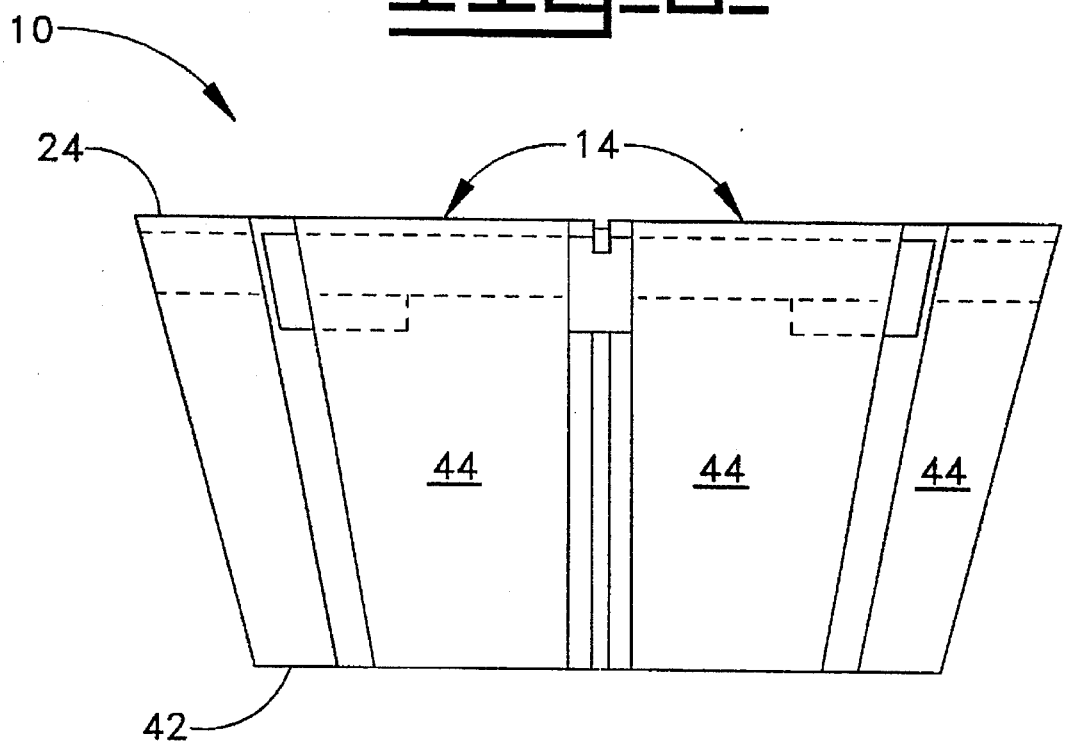
FIG. 2 is a side elevational view of the crimping die illustrated in FIG. 1.
Figure 3:
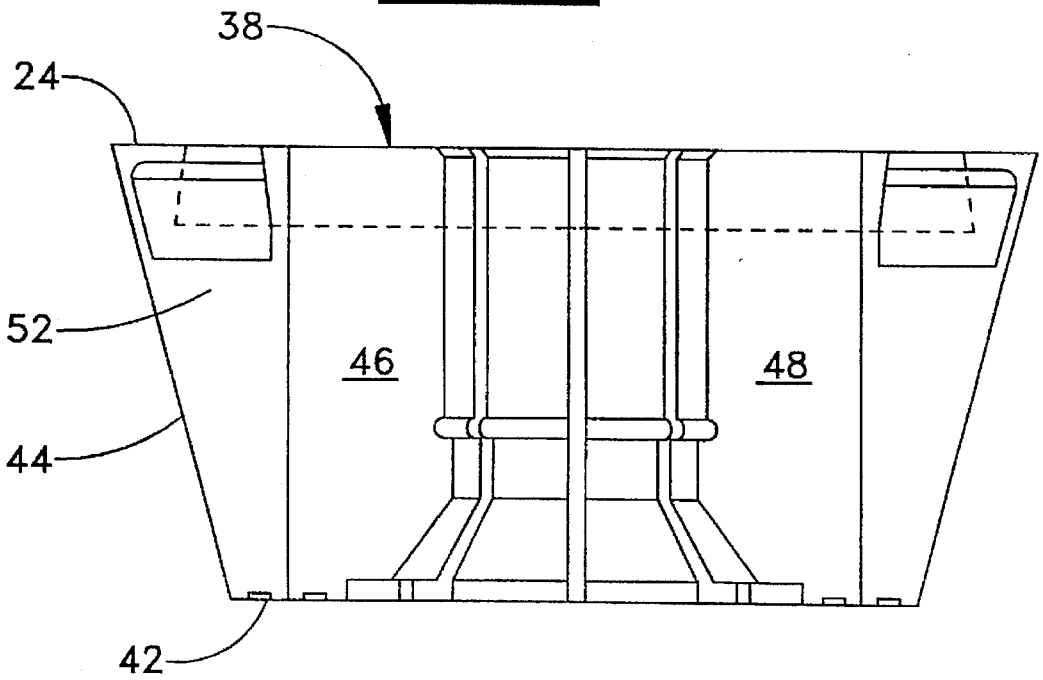
FIG. 3 is a sectional view taken along line 3—3 of FIG. 1 showing one of the die halves in elevation.

Referring more particularly to the drawings, a crimping die embodying the principles of the present invention is illustrated at 10 in FIG. 1. Crimping die 10 is intended for use in a crimping machine for radially crimping the collar of a hose coupling onto the end of a hose. Such crimping machine may be of a conventional construction, many of which are well known in the art and, therefore, is not shown in the drawings and will only be described in limited detail below. Those skilled in the art will also appreciate that hose couplings adapted for crimping onto the end of a hose are also conventional and well known and are likewise not shown in the drawings. Conventional crimping machines typically have a die plate with a frusto-conical through bore adapted to receive a crimping die with a mating radially outer conical surface. The conventional crimping die is typically constructed from a plurality of pie-shaped segments arranged in a circular array around a central axial bore. The segments are spaced apart from each other in the expanded mode so as to permit the hose coupling which is to be crimped to be placed in the central bore. The segments are then driven axially downward, typically by a hydraulic jack of the crimping machine, into the conical bore of the die plate, which converts the axial movement of the die segments into a radial contraction by the camming action of the conical bore of the die plate on the radially outer conical surfaces on the die segments. Thus, the die segments are compressed radially so as to make the central bore smaller and causing the radially inner surfaces of the die segments forming the bore to work the metal of the hose coupling and to radially reduce its size.

Figure 4:
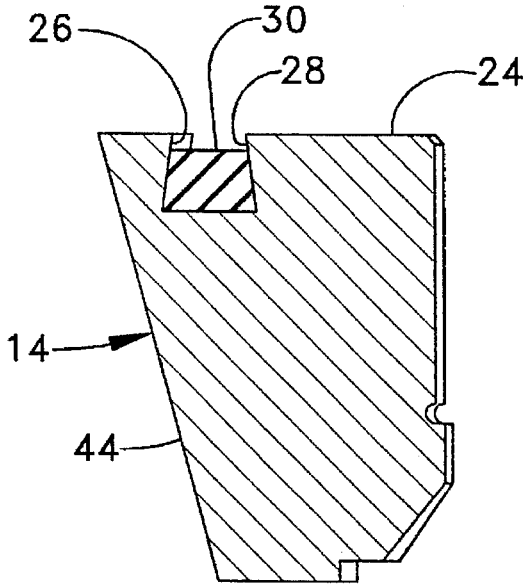
FIG. 4 is a cross-sectional view of one of the die segments taken along line 4—4 of FIG. 1.
Figure 5:
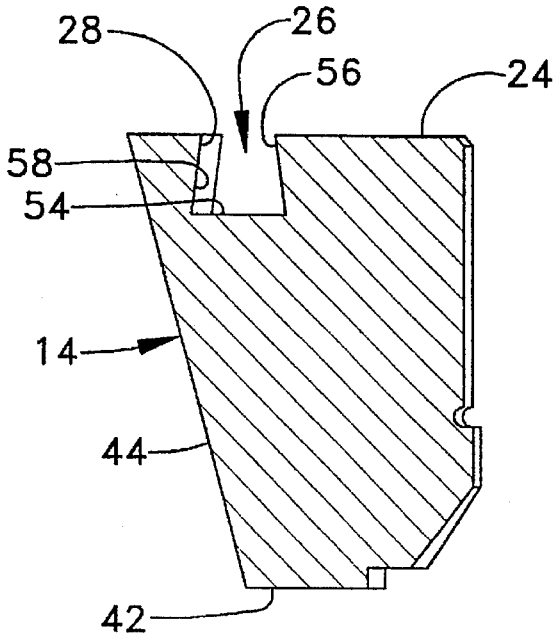
FIG. 5 is a cross sectional view similar to FIG. 4, but with the retaining band removed.

Those skilled the art will appreciate that crimping die 10 shown and describe herein may be modified as needed to accommodate various known variations in conventional crimping machines for radially crimping the collar of a hose coupling onto the end of a hose without departing from or limiting the scope of the present invention. With this in mind, crimping die 10 of the present invention includes a die assembly 12 having a plurality of die segments 14 and at least one unitary retention and separator band 16. The die segments 14 are adapted for arrangement into a circular array about a central axis 18. (It should be noted that two center points of axis 18 are shown in FIG. 1 because the halves of the die assembly are shown separated slightly for illustrative purposes.) Each of the die segments 14 have a radially inner surface 20 forming a section of a common collar bore 22 about the central axis 18 for receipt of the collar of the hose coupling (not shown). Each die segment 14 includes a top surface 24 having an arcuate groove 26 formed therein. As best shown in FIGS. 4 and 5, the groove 26 has a predetermined cross-sectional configuration with an open upper end 28 that is provided with a lesser width than the width of at least a portion of the groove below the upper end 28.

The unitary retention and separator band 16 is constructed of an elastomeric material, such as rubber or the like, and has a like plurality of die segment retaining portions 30 and a plurality of spacer portions 32. Each retaining portion 30 has a cross-sectional configuration that mates with and is adapted for receipt into the groove 26 of a respective one of the segments 14 for retaining the segments together. The spacer portions 32 are spaced along the band 16 for disposition between adjacent ones of the die segments 14 and have a length to space the segments a predetermined distance apart when the die assembly 12 is in a free state. Such predetermined distance is such to provide the common bore 22 of the crimping die 10 with a size to accept the receipt of collar of the hose coupling into the bore before the collar is crimped.

While the present invention is intended to cover a crimping die wherein the unitary retention and separator band 16 is constructed in a continuous ring or a split ring, it is preferable that band 16 be constructed in two substantially semi-circular halves such as shown at 34 and 36 of FIG. 1. Thus, the crimping die 10 is provided with a pair of complementary, generally semi-circular die assemblies 38, 40.

Each die segment 14 also includes a bottom surface 42, a conically shaped radially outer surface 44 and a pair of radially extending side surfaces 46, 48. The outer surface 44 is substantially straight and uninterrupted from the top surface 24 to the bottom surface of the die segment 14 to maximize its surface area and to eliminate any discontinuities that might otherwise be found in such outer surface by the inclusion of grooves, cavities or the like therein. Each of the side surfaces 46, 48 has a radially outer portion 52 adjacent the radially outer surface 44, which is stepped in from the remainder of the side surface 48. The band groove 26 is preferably located outboard in the top surface 24 toward the radially outer surface 44 such that the opposite ends of the groove in each segment opens into the stepped outer portion 52 of each side surface 46, 48. The space provided by the stepped outer portion 52 is sufficient to accommodate a respective one of the spacer portions 32 of the band 16 and to provide room for the expansion of the spacer portions 32 upon the radial contraction of the die assembly 12 during the crimping of the hose coupling.

The band groove 26 (FIG. 5) in each of the segments 14 has a bottom surface 54 and preferably has a generally dove-tail configuration with inner and outer circumferentially extending sides 56, 58, respectively, that diverge away from each other from the open upper end 28 to the bottom surface 54. In particular, each groove 26 is generated by radii whose centers are substantially coincident to the central axis 18 of the die assembly 12.

Figure 6:
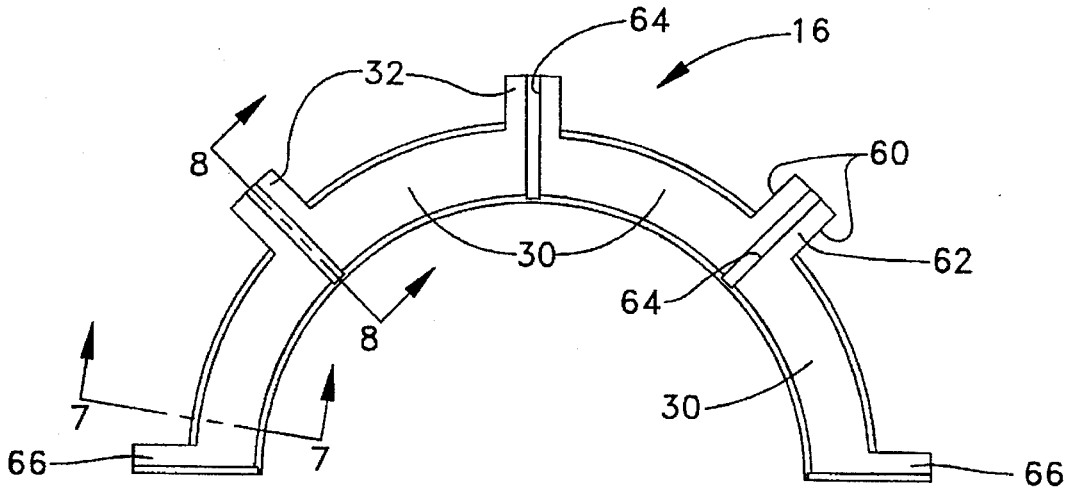
FIG. 6 is a top elevational view of one of the retention and separator bands by itself.
Figure 7:
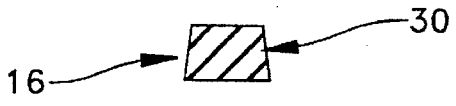
FIG. 7 is a cross-sectional view taken along line 7—7 of FIG. 6 through one of the retaining portions of the band.
Figure 8:
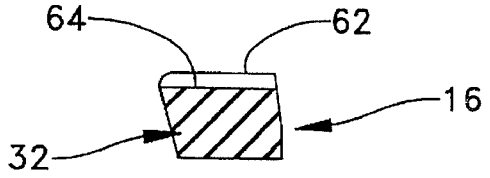
FIG. 8 is a cross-sectional view taken along line 8—8 of FIG. 6 through one of the spacer portions of the band.

As best shown in FIGS. 6–8, the retaining portions 30 of the unitary retention and separator band 16 is provided with a trapezoidal cross-sectional configuration that matches the dove-tail configuration of the band groove 26 such that each retaining portion 30 is snugly received into the band groove 26 of a respective one of the segments 14. The fit between the retaining portion 30 and its respective groove 26 is such that the retaining portion 30 will not come out of the groove 26 during normal use and handling of the die assembly 12. However because of the resilient material used to construct the band 16, the retaining portion 30 can be worked into or out of the groove 26 by applying manual force sufficient to cause the necessary compression of the band to allow its insertion into or removal from the groove 26. This permits the easy and rapid replacement of individual segments 14 of the die assembly 12 as they become worn or damaged from use.

As is readily apparent from FIGS. 6 and 8, the spacer portions 32 of the band 16 have a cross-sectional configuration of a size greater than the retaining portions 30 to extend beyond the sides of the band groove 26. Each spacer portion 32 has opposite sides 60. Each side 60 is disposed in abutting relationship to the stepped outer portion 52 of a respective one of radially extending sides 46, 48 of the adjacent die segment 14 such that each segment 14 is captured between a pair of such spacer portions 32 of the band 16.

Each of the spacer portions 32 has an upper surface 62 that preferably provided has a radially extending groove 64 formed therein. Groove 64 is of sufficient size to provide a space for the expansion of the resilient material of the spacer portions 32 upon the radial contraction of the die assembly during the crimping of the hose coupling. Because the band 16 is segmented into halves 34 and 36, each of the band halves 34, 36 have opposite ends, each of which is provided with one of a pair of end spacer portions 66. Each end spacer portion 66 has a decreased length that is substantially half the length of the intermediate spacer portions 32 previously described. Each such end spacer portion is positionable adjacent a respective one of the end portions of the band of the other die assembly half when the die halves are in their assembled crimping position.

Industrial Applicability

The construction of the present crimping die 10 is effective in crimping collars of hose couplings onto the ends of hoses, while eliminating the disadvantages of prior crimping die devices. In particular, the use of the unitary band 16 with retaining portions 30 fitted into their respective grooves 26 of the die segments 14 are effective in retaining all of the segments of the respective die halves 38, 40 together during handling and use. The respective spacer portions 32 or end spacer portions 66 maintain their respective die segments 14 in a proper open position to receive the collar of the hose coupling. The resilient elastomeric material of the band is sufficient to allow the spacer portions 32 and spacer end portions 66 to be compressed during the crimping operation and to recover thereafter causing the segments 14 to be restored to their expanded position when the crimping operation is concluded. The elastomeric nature of the band 16 also allows the retaining portions 30 to be manually inserted into their respective grooves 26 to permit the easy and rapid replacement of worn or damaged segments without the use of tools or time consuming operations.

Because the groove 26 is beneficially located on the top surface 24 of the die segment 14, no grooves or other discontinuities are needed along the outer surface 44 of the segment through which the crimping force is transmitted. Thus, the surface area on the outer surface is maximized and discontinuities are eliminated which reduce any instability between the segments 14 and the die block of the crimping machine and provide greater mating surface contact therebetween to prevent or reduce the occurrence of galling or other surface damage.

Because the present construction of the die assembly requires no bonding of any portion of the band 16 to the segments 14, there is no risk of a bond failure due to bond fatigue or the like. Thus, the segments 14 will not come loose in handling or use, which can lead to damage or time consuming repairs.

Other aspects, objects and advantages of the present invention can be obtained from a study of the drawings, the disclosure and the appended claims.

We claim:

1. In a crimping die for use in a crimping machine for radially crimping the collar of a hose coupling onto the end of a hose, the improvement wherein said crimping die comprises:

a die assembly having a plurality of die segments and at least one unitary retention and separator band, said die segments being adapted for arrangement into a circular array about a central axis and with each of said die segments having a radially inner surface forming a section of a common collar bore about said central axis for receipt of said collar of the hose coupling;

each die segment including a top surface having an arcuate groove formed therein, said groove having a predetermined cross-sectional configuration with an open upper end that is provided with a lesser width than the width of at least a portion of the groove below said upper end; and said unitary retention and separator band being constructed of an elastomeric material and having a like plurality of die segment retaining portions and a plurality of spacer portions, each retaining portion having a cross-sectional configuration that mates with and is adapted for receipt into the groove of a respective one of said segments for retaining said segments together, and said spacer portions being spaced along said band for disposition between adjacent ones of said die segments and having a length to space said segments a predetermined distance apart when said die assembly is in a free state.

2. The crimping die as set forth in claim 1 wherein each of said die segments includes a bottom surface and a conically shaped outer surface, said outer surface being substantially straight and uninterrupted from said top surface to said bottom surface.

3. The crimping die as set forth in claim 2 wherein each of said die segments includes a pair of radially extending side surfaces, each said side surface having a radially outer portion adjacent said radially outer surface, which is stepped in from the remainder of the side surface a sufficient space to accommodate a respective one of said spacer portions of said band and to provide space for the expansion of said spacer portion upon the radial contraction of said die assembly during the crimping of said hose coupling.

4. The crimping die as set forth in claim 1 wherein each of said grooves in said segments has a bottom surface and a generally dove-tail configuration with inner and outer circumferentially extending sides that diverge away from each other from the open upper end to the bottom surface, said grooves being generated by radii whose centers are substantially coincident to the central axis of said die assembly.

5. The crimping die as set forth in claim 4 wherein said spacer portions of said band have a cross-sectional configuration of a size greater than said retaining portions and have opposite sides, each side being disposed in abutting relationship to outer portion of a respective one of radially extending sides of the adjacent die segment such that each segment is captured between a pair of such spacer portions of the band.

6. The crimping die as set forth in claim 5 wherein each of said spacer portions has an upper surface, said upper surface having a radially extending groove formed therein of sufficient size to provide a space for expansion of the resilient material of said spacer portions upon the radial contraction of said die assembly during the crimping of said hose coupling.

7. In a crimping die for use in a crimping machine for radially crimping the collar of a hose coupling onto the end of a hose, the improvement wherein said crimping die comprises:

a pair of generally semi-circular die assemblies, each die assembly including a plurality of die segments and a unitary retention and separator band, the die segments of said pair of die assemblies being adapted for arrangement into a circular array and with each of said die segments having a radially inner surface forming a section of a common collar bore about said collar of the hose coupling;

each die segment including a top surface having an arcuate groove formed therein, said groove having a dovetail-like cross-sectional configuration with an open upper end that is provided with a lesser width than the width of at least a portion of the groove below said upper end; and each unitary retention and separator band being of a generally semi-circular configuration with opposite ends and being constructed of an elastomeric material and having a like plurality of die segment retaining portions, a plurality of intermediate spacer portions and a pair of end spacer portions, each retaining portion having a cross-sectional configuration that mates with and is adapted for receipt into the groove of a respective one of said segments for retaining said segments together, said intermediate spacer portions being spaced along said band for disposition between adjacent ones of said die segments of said die assembly and having a length to space said segments a predetermined distance apart when said die assembly is in a free state, and said end portions being disposed at a respective one of the opposite ends of said band and having a length that is substantially half the length of said intermediate spacer portions, each such end portion being positionable adjacent a respective of the end portions of the band of the other die assembly.

8. The crimping die as set forth in claim 7 wherein each of said die segments includes a bottom surface and a conically shaped outer surface, said outer surface being substantially straight and uninterrupted from said top surface to said bottom surface.

9. The crimping die as set forth in claim 7 wherein each of said die segments includes a pair of radially extending side surfaces, each said side surface having an inner portion adjacent said radially inner surface and an outer portion adjacent said radially outer surface, which is stepped in from the remainder of the side surface a sufficient space to accommodate a respective one of said spacer portions of said band and to provide space for the expansion of said spacer portion upon the radial contraction of said die assembly during the crimping of said hose coupling.

10. The crimping die as set forth in claim 7 wherein each of said dove-tail grooves have inner and outer circumferentially extending sides that diverge away from each other from the open upper end to the bottom surface, said grooves being generated by radii whose centers are substantially coincident to the central axis of said die assembly.

11. The crimping die as set forth in claim 10 wherein said spacer portions of said band have a cross-sectional configuration of a size greater than said retaining portions and have opposite sides, each side being disposed in abutting relationship to outer portion of a respective one of radially extending sides of the adjacent die segment such that each segment is captured between a pair of such spacer portions of the band.

12. The crimping die as set forth in claim 11 wherein each of said spacer portions has an upper surface, said upper surface having a radially extending groove formed therein of sufficient size to provide a space for expansion of the resilient material of said spacer portions upon the radial contraction of said die assembly during the crimping of said hose coupling.

* * * * *